US009452396B2

(12) United States Patent
Seefried

(10) Patent No.: US 9,452,396 B2
(45) Date of Patent: Sep. 27, 2016

(54) ROTOR FOR HOMOGENIZING FLOWABLE MEDIA

(75) Inventor: Erwin Seefried, Weyhe (DE)

(73) Assignee: NETZSCH VAKUMIX GMBH, Selb (DE)

( * ) Notice: Subject to any disclaimer, the term of this patent is extended or adjusted under 35 U.S.C. 154(b) by 0 days.

(21) Appl. No.: 13/486,313

(22) Filed: Jun. 1, 2012

(65) Prior Publication Data

US 2012/0307585 A1 Dec. 6, 2012

(30) Foreign Application Priority Data

Jun. 1, 2011 (EP) ..... 11168428

(51) Int. Cl.
*B01F 7/00* (2006.01)
*B01F 7/16* (2006.01)

(52) U.S. Cl.
CPC ..... *B01F 7/163* (2013.01); *B01F 7/00241* (2013.01)

(58) Field of Classification Search
CPC ..... B01F 3/04773; B01F 7/16; B01F 7/163; B01F 7/00241
USPC ..... 366/336, 263, 265, 317, 279, 302
See application file for complete search history.

(56) References Cited

U.S. PATENT DOCUMENTS

| | | | | |
|---|---|---|---|---|
| 2,619,330 | A * | 11/1952 | Willems | 366/263 |
| 4,869,657 | A * | 9/1989 | Kurokawa | 366/263 |
| 2011/0085945 | A1* | 4/2011 | Mochizuki | B01F 5/0604 366/270 |

FOREIGN PATENT DOCUMENTS

| | | | |
|---|---|---|---|
| CN | 2882772 | Y * | 3/2007 |
| DE | 19537303 | | 3/1997 |
| EP | 0988887 | | 3/2000 |
| SU | 1380975 | | 3/1988 |
| WO | 02/060569 | | 8/2002 |

OTHER PUBLICATIONS

EPO Machine Translation of DE 19537303 Description, published Mar. 6, 1997.
English Abstract of EP0988887 Al, published Mar. 29, 2000.
English Abstract of SU 1380975, published Mar. 15, 1988.

* cited by examiner

*Primary Examiner* — Tony G Soohoo
*Assistant Examiner* — Anshu Bhatia
(74) *Attorney, Agent, or Firm* — Casimir Jonse, S.C.; Mary Ann Brow

(57) ABSTRACT

The invention relates to a dispersing rotor for homogenizing free-flowing media. According to the invention, the rotor-toothing formation forms a labyrinth toothing formation for a medium passing radially outward. The invention allows effective homogenization of free-flowing media by this rotor alone, without interaction with a stator-toothing formation being necessary.

22 Claims, 8 Drawing Sheets

ROTOR FOR HOMOGENIZING FLOWABLE MEDIA

The present invention claims the benefit of European Patent Application 11168428.8, filed Jun. 1, 2011, which is incorporated herein by reference in its entirety.

The invention relates to a dispersing rotor which is intended for homogenizing free-flowing media and has an axially oriented toothing formation.

Homogenizers are used, inter alia, in the pharmaceutical, cosmetics, chemical and food industries in order to produce creams, ointments, pastes, mayonnaises and similar products. A homogenizer, usually designed as a rotor/stator dispersing machine, is customarily arranged at the base of a mixing tank. Such a homogenizer is disclosed, for example, in EP 0 988 887 A1.

It is an object of the invention to provide a possible means of homogenizing free-flowing media which is straightforward, efficient and versatile to use.

A dispersing rotor according to the invention has a toothing formation which forms a labyrinth toothing formation for medium passing radially outward from the direction of the rotor axis.

A few terms used within the context of the invention will be explained first of all. The dispersing rotor according to the invention serves for dispersing (homogenizing, emulsifying or suspending) free-flowing media. This also includes the production of single-phase or multi-phase mixtures such as gels, emulsions or suspensions. The dispersing rotor has an axially oriented toothing formation. The term toothing formation refers to openings in a circumferentially running wall of the rotor, through which medium or mixing substance passes radially outward during operation. Such a toothing formation may have individual openings in an otherwise closed, circumferentially running wall. It is usual, however, for the toothing formation to be formed by a multiplicity of axially extending teeth which are arranged over a circumferential portion of the rotor and have deflecting surfaces for the medium which is to be mixed. The terms axial(ly) and radial(ly), within the context of the present invention, refer to the axis of rotation of the rotor. According to the invention, the rotor-toothing formation forms a labyrinth toothing formation for medium passing radially outward from the direction of the rotor axis. The term labyrinth toothing formation means that mixing substance fed in the region of the axis of the rotor cannot, as a result of the toothing formation, pass out along a radially oriented straight line; rather, the arrangement of the teeth means that the mixing substance always has to change direction, that is to say has to flow through a labyrinth path.

The invention has recognized that, surprisingly, a good mixing and homogenizing action can be achieved by such a rotor alone, without the latter having to interact with a stator-toothing formation (usually fixed in position) which rotates relative to the rotor. The labyrinth toothing formation according to the invention allows good mixing and homogenization by the use of such a dispersing rotor alone.

According to the invention, the homogenization of the medium is considerably more economical than if use is made of a rotor/stator dispersing machine of the prior art, since a smaller amount of energy is introduced and thus also a lower level of heat is developed. The amount of mechanical energy which has to be used for the homogenization is also correspondingly lower. The reduced amount of heat introduced allows more gentle homogenization of sensitive products such as gels or creams.

The invention has thus recognized that there is no need for the pronounced shearing of the medium on alternating rotor and stator teeth, which is deemed necessary in the prior art; instead, the constant changes in speed in the labyrinth path allow the expansion and comminution of liquid droplets (for example of emulsions) and therefore homogenization. As it passes through a row of teeth, the medium is subjected, by the rotating rotor, to an impulse which, depending on the speed and flow direction of the medium and rotational speed of the rotor, results in a corresponding change in flow direction and flow speed of the medium.

The dispersing rotor according to the invention preferably has, at it were, rows of teeth. A row of teeth is an arrangement of teeth provided over a circumference circle and thus being spaced apart radially from the rotor axis by the same distances.

The dispersing rotor is preferably closed at one or both axial ends. This means that, in the closed region, no medium, or at most only a small amount of medium, can pass out in the axial direction. Preferably, rather than the entire circular surface area of the rotor being closed at both axial ends, there is a central opening at least at one axial end, it being possible for medium to enter through this opening from one axial side. Preferably, at least at one axial end (end side), it is only that circular ring which is occupied by the rotor-toothing formation which is closed. This ensures that medium passing through passes through the dispersing rotor radially from the inside outward over the labyrinth paths provided.

The axial height of the rotor-toothing formation may be 10 to 30 mm, further preferably 12 to 25 mm. The term refers to the free height in the annular plane of the corresponding rotor-toothing formation through which medium can pass. The diameter of a dispersing rotor according to the invention may be adapted to the given installation conditions. In the case of installation, for example, in conduits, small diameters of, for example, 5 to 10 cm can be used. In the case of installation in relatively large mixing tanks, the diameter may be located, for example, between 10 and 30 cm. The aforementioned values can be combined as desired to give upper and lower limits according to the invention.

The teeth of the rotor-toothing formation preferably have radially directed gaps between them of 0.3 to 3 mm, preferably 0.5 to 1.5 mm. These gaps preferably constitute the clear radial distance between in each case two concentrically arranged rows of teeth.

The teeth (preferably the teeth of in each case one of the concentric rows of teeth) preferably have circumferentially directed gaps of 0.5 to 4 mm, further preferably 1 to 3 mm, further preferably 1.5 to 2.5 mm.

The coverage of a row of teeth over the circumference of this row of teeth is preferably between 40 and 80%, further preferably 50 and 70%. These limits can be combined as desired to give ranges according to the invention. The term coverage here refers to that proportion of the circular circumference of a row of teeth over which the through-passage of medium in the radial direction through this row of teeth is blocked. Coverage of 60% means, for example, that 60% of the circumference of the corresponding row of teeth is blocked by the teeth whereas medium can pass through over the remaining 40% of the circumference.

In the case of a particularly preferred embodiment of the invention, two radially adjacent rows of teeth provide, together, for full coverage. This means that medium cannot pass through these two radially successive rows of teeth without deviating from the radial direction. A straight line in the radial direction which passes through a gap between two teeth in one of the two rows of teeth thus comes up against a tooth in the other of these two rows of teeth. This full coverage of two radially adjacent rows of teeth gives rise to improved homogenization as a result of the medium thus having to change direction to a more pronounced extent.

According to the invention, at least some of the teeth preferably have circumferentially oriented delivery surfaces which are designed in order to subject medium which comes into contact therewith to an impulse component in the radially outward direction. "Circumferentially oriented" here does not mean that these surfaces are oriented precisely in the circumferential direction; a perpendicular to these surfaces thus being oriented precisely in the circumferential direction. Rather, the surfaces are usually oblique surfaces, and a perpendicular to these oblique surfaces preferably has a direction component oriented radially outward. If, when the dispersing rotor is rotating, this delivery surface comes into contact with medium passing through, the medium is subjected to an impulse which has a direction component oriented radially outward. Accordingly, the medium is accelerated with an acceleration or speed component oriented radially outward.

The invention also relates to a homogenization apparatus which is intended for homogenizing free-flowing media and has a dispersing rotor according to the invention. Dispensing with a stator-toothing formation gives a series of significant advantages. It is possible for the dispersing rotor to be positioned relatively freely within the homogenization apparatus, since no structural provisions have to be made to supply a stator-toothing formation which engages in the rotor-toothing formation. According to the invention, the dispersing rotor may be arranged, for example, in a lower region of a homogenization tank, preferably in the base region thereof. It is likewise possible for a plurality of dispersing rotors to be arranged within a tank, for example for a plurality of such rotors to be arranged on a spindle guided through the lid or base of such a tank. It is likewise possible, within the context of the invention, to arrange the dispersing rotor in a conduit through which medium which is to be mixed is channeled. The dispersing rotor according to the invention can thus be used for so-called in-line mixing in a conduit.

Dispensing with a stator-toothing formation makes it possible for the dispersing rotor according to the invention to be installed in a homogenization tank with greater tolerances than in the prior art, where accurate interaction with a stator-toothing formation is necessary. This allows, in particular, the use of drives in which the rotor is mounted usually with relatively large tolerances, for example contactless drives such as magnetic drives. Contactless drives have the advantage that there is no need for drive spindles to be led through the wall of the homogenization tank, and thus the tank and dispersing rotor may be configured so as to optimize the possibilities in respect of cleaning and sterilization.

Exemplary embodiments of the invention will be described hereinbelow with reference to the drawings, in which.

Figure 1:
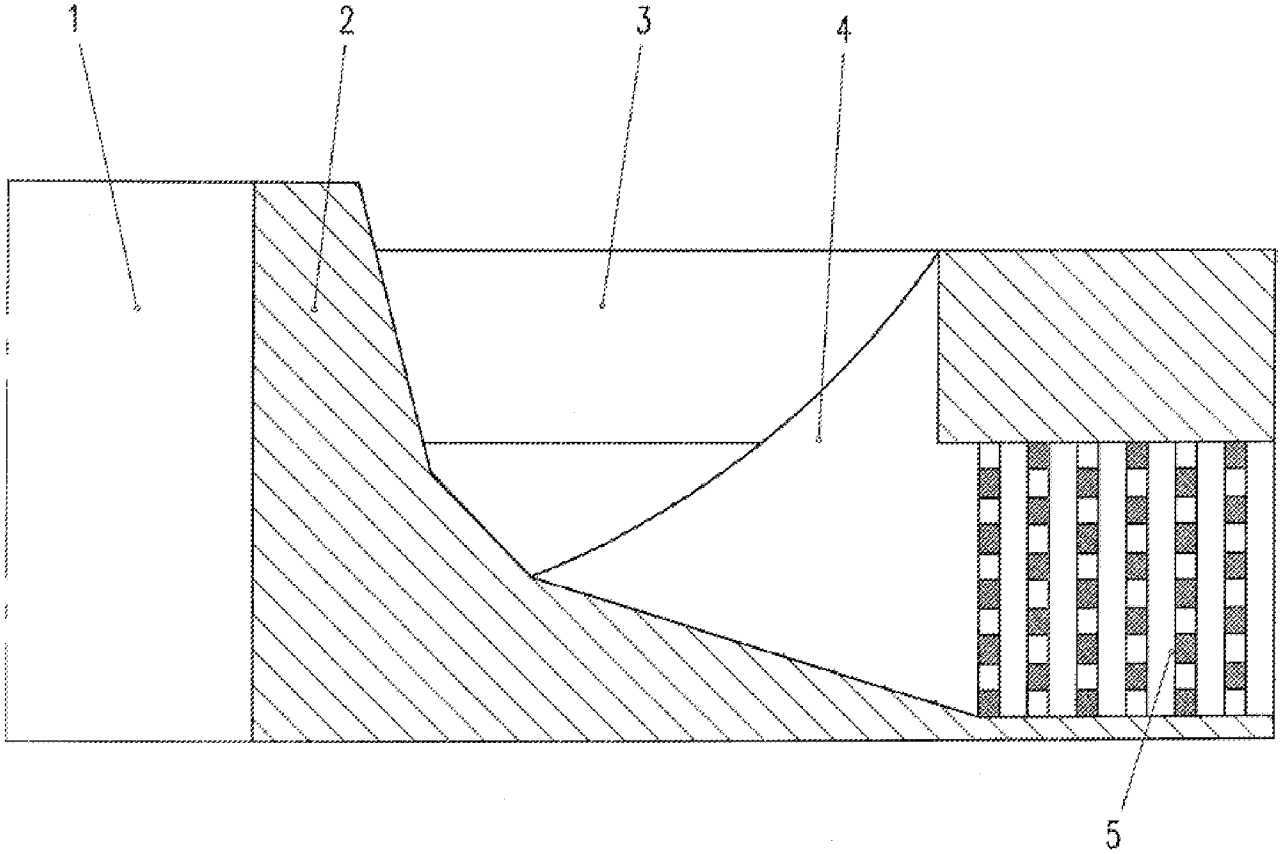
FIG. 1 shows, schematically, a partial axial section through a dispersing rotor according to the invention.

The dispersing rotor according to the invention has a mount 1 for a drive shaft (not illustrated in FIG. 1). Connected in a rotationally fixed manner thereto is a rotor 2, on which are arranged pumping impellers 4, by means of which medium entering through the inlet 3 is delivered in the radially outward direction. The arrangement of the pumping impellers 4 corresponds, for example, to the arrangement which is illustrated in EP 0 988 887 A1, in said document pumping impellers 18 in FIG. 2.

In a radially outer circular ring, the dispersing rotor according to the invention has four radially staggered rows 5 of teeth, through which medium entering into the inlet 3 is channeled away in the radially outward direction. These rows of teeth form a labyrinth path for medium passing in the radially outward direction, that is to say medium cannot pass through these rows of teeth without changing direction. In the region of the toothing formation 5, the dispersing rotor is closed off in the direction of the axial end sides, and therefore mixing substance cannot depart from the toothing formation axially upward or downward.

Figure 2:
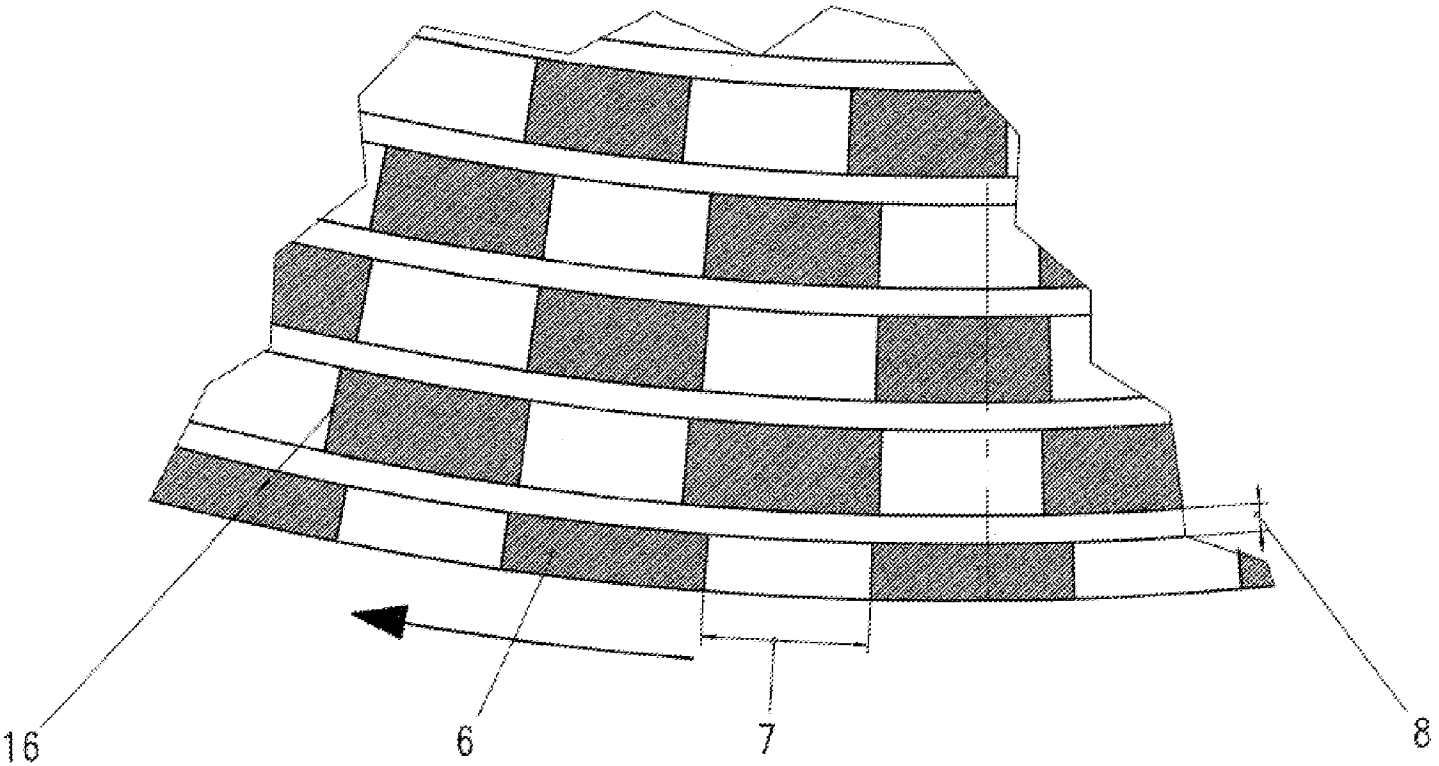
FIG. 2 shows, schematically, a section in the radial plane through a rotor-toothing formation according to the invention.

Six radially staggered rows of teeth are arranged in the exemplary embodiment of FIG. 1. FIG. 2 shows, schematically, a radial section through these rows of teeth. It is possible to see radially staggered rows of teeth, each having teeth 6. FIG. 2 is an enlarged illustration. The length of the gaps in the circumferential direction (reference sign 7) is approximately 2 mm; the gap width in the radial direction (reference sign 8) is approximately 0.5 mm. It can be seen that the teeth 6 form a labyrinth path through which medium has to pass in the outward direction. If the rotor is rotated in the circumferential direction, as indicated by the arrow, the circumferentially running surfaces 16 of the teeth form delivery surfaces which, as they come into contact with the medium, subject the latter to a radially outwardly oriented impulse component.

The diameter of the dispersing rotor illustrated in FIG. 1 may be approximately 10 cm in the case of this exemplary embodiment. Typical rotational speeds during operation may be, for example, 6,500 to 14,000 $min^{-1}$.

Figure 3:
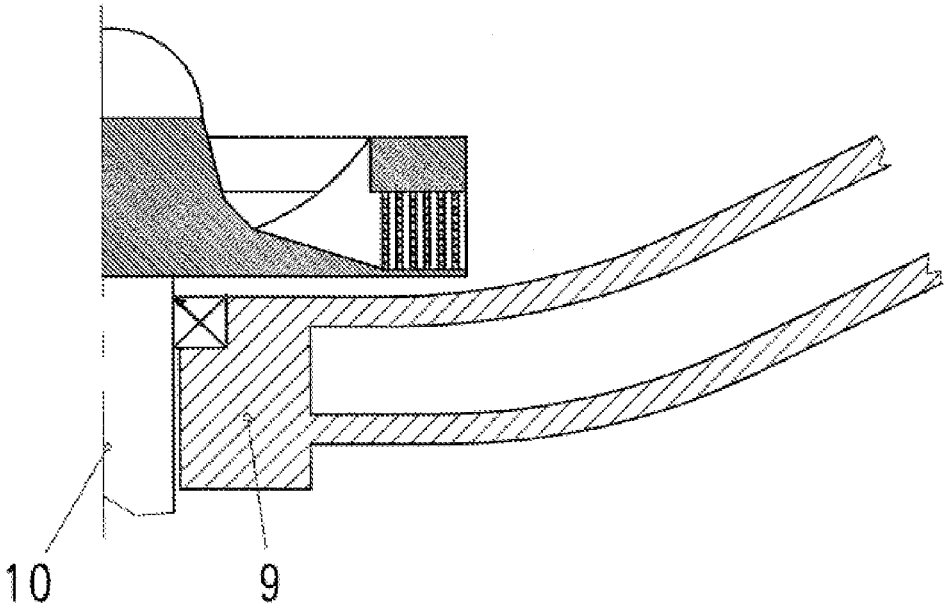
FIGS. 3-7 show, schematically, different situations where a dispersing rotor according to the invention is installed in a homogenization apparatus.

FIG. 3 shows, schematically, an installation situation in which a dispersing rotor according to the invention is arranged in a mixing tank, above the tank base 9. A drive shaft 10 passes through the tank base.

Figure 4:
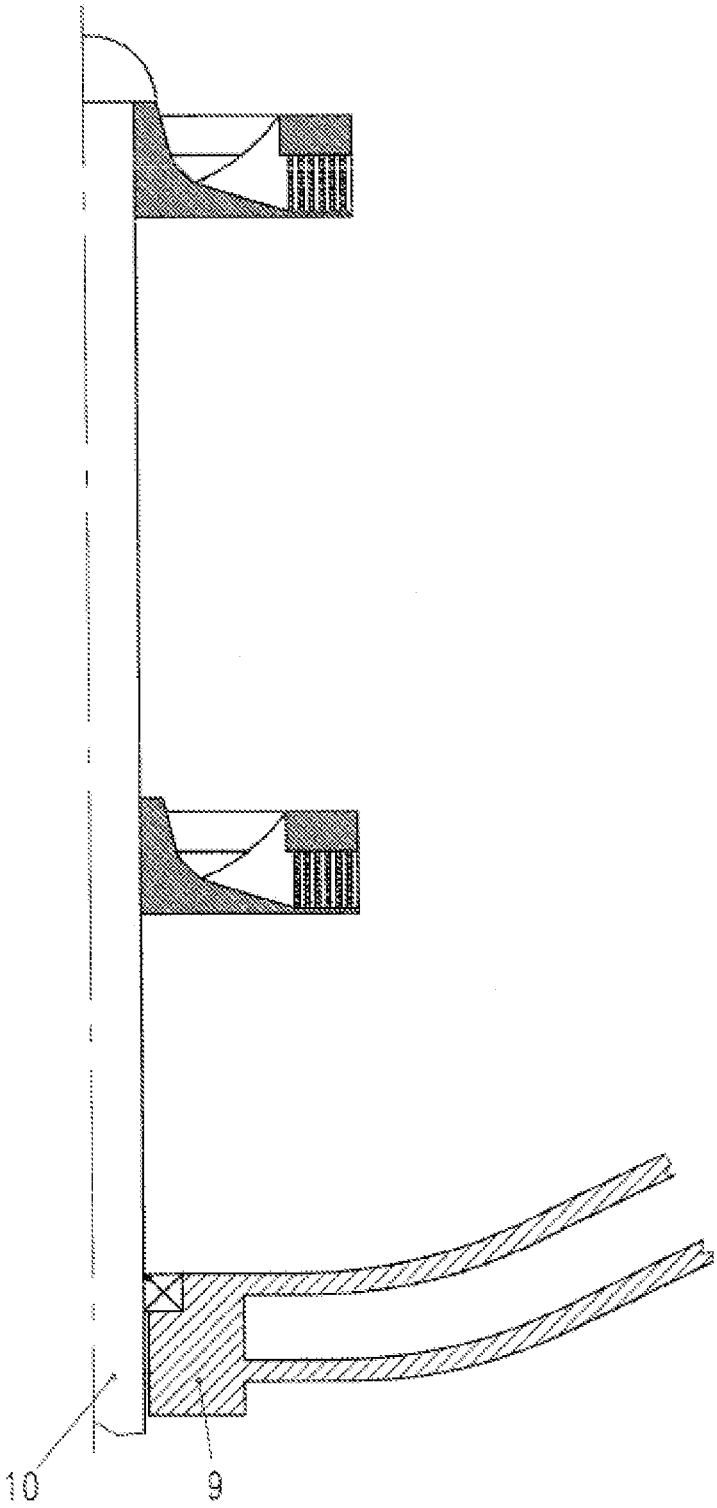

FIG. 4 shows another variant of a homogenization apparatus according to the invention, in the case of which a relatively long drive shaft 10 passes through the tank base 9. Two or, if required, more dispersing rotors according to the invention are arranged on this drive shaft 10.

Figure 5:
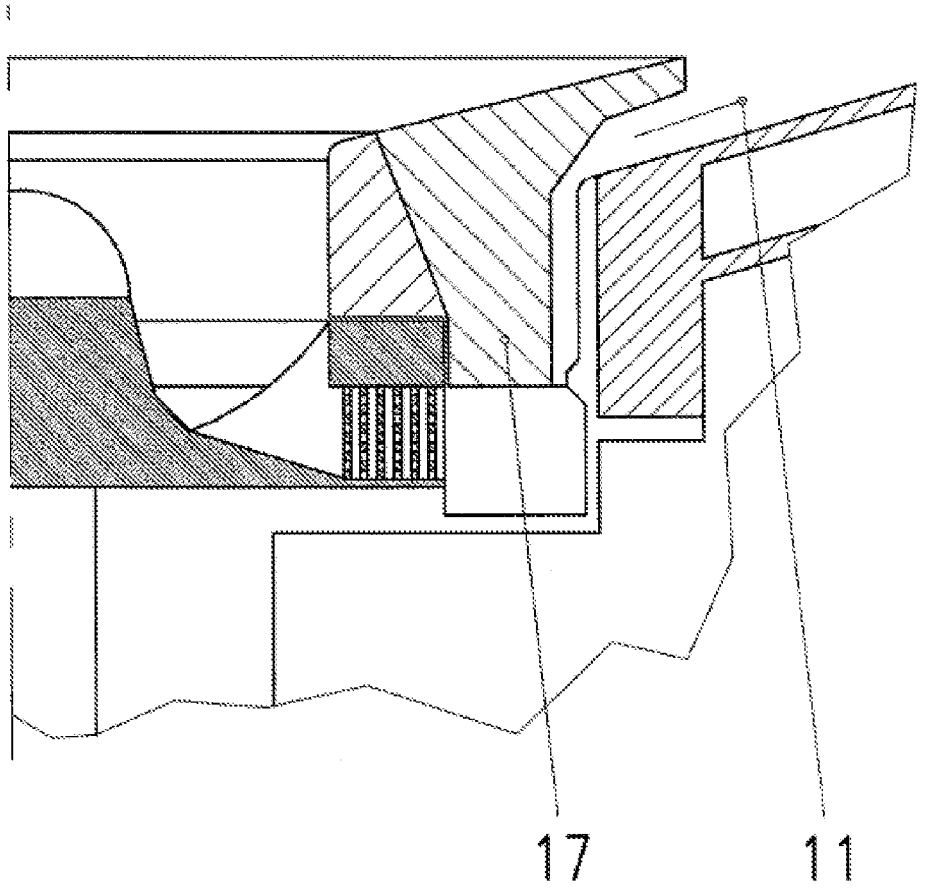

In the case of the embodiment of FIG. 5, a dispersing rotor according to the invention is installed in the base housing of a mixing tank. A cover 17 covers the rotor on its outer circumference and, together with the base housing, forms an annular gap 11 through which medium which passes out along the outer circumference of the rotor can be channeled back into the tank. As an alternative, it is possible for this medium to be channeled away out of the tank through a circulation line (not illustrated in FIG. 5) and to be fed back again, for example, in some other (preferably upper) region of the tank.

Figure 6:
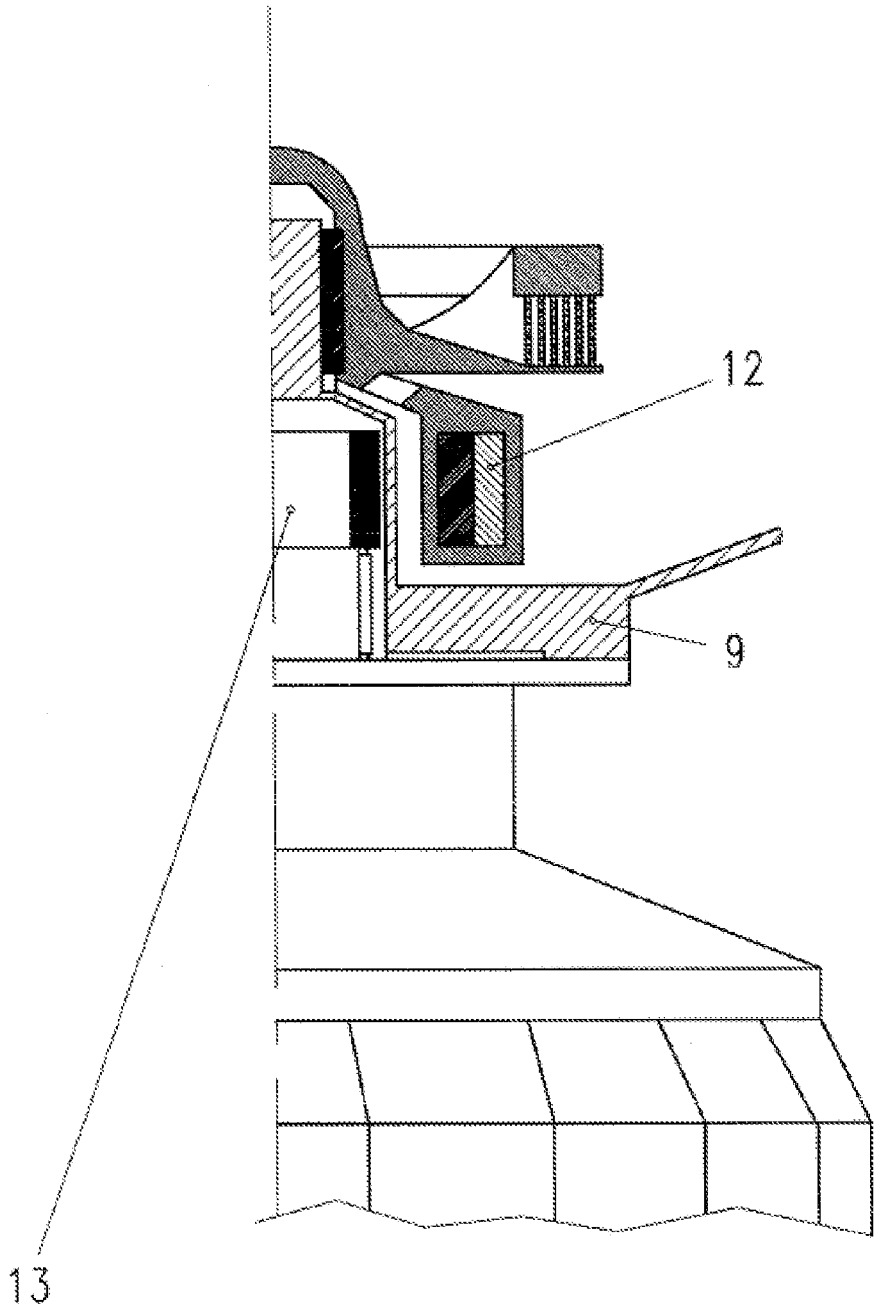

FIG. 6 shows an embodiment in which the rotor is driven via a magnetic coupling. A drive shaft 13 is arranged outside the tank wall 9, this drive shaft being provided with magnets and carrying along magnets 12 which are arranged within the tank and are connected in a rotationally fixed manner to the rotor.

Figure 7:
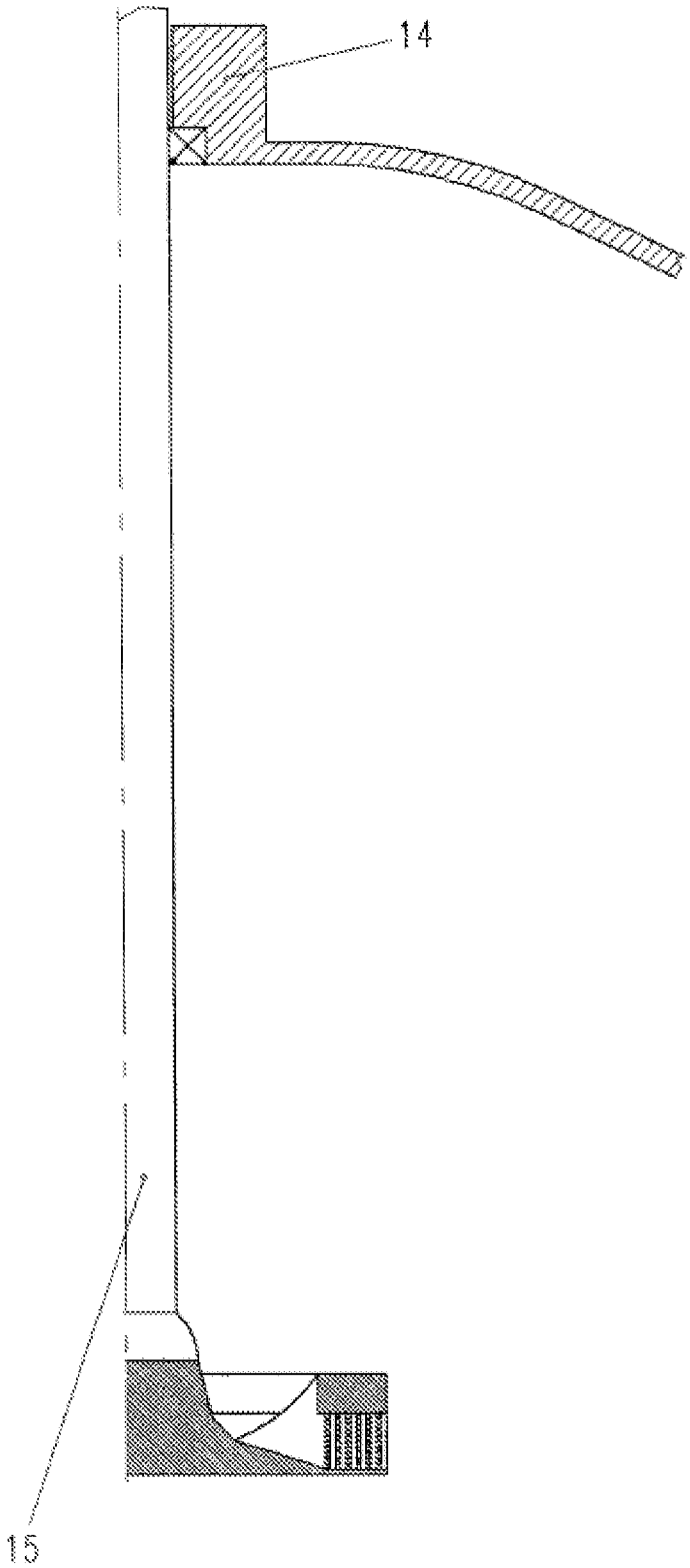

FIG. 7 shows an embodiment in which a drive shaft 15 is led through the lid 14 of a mixing tank.

Figure 8:
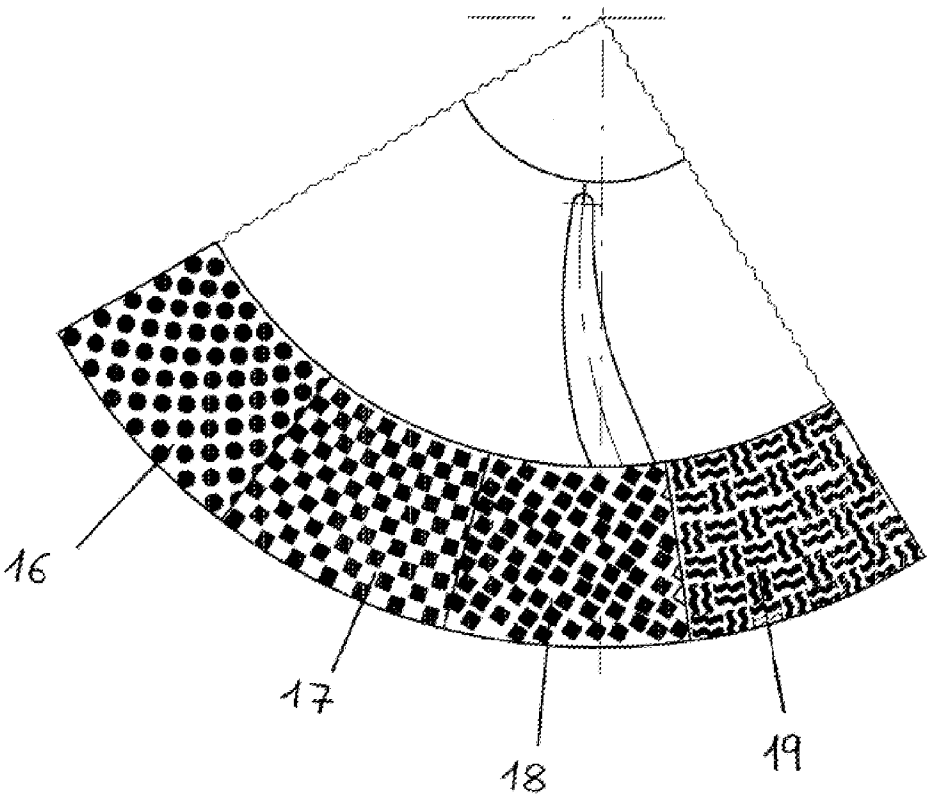
FIG. 8 shows, schematically, further possible configurations in respect of a labyrinth-toothing formation.

FIG. 8 shows, schematically, further possible configurations of a labyrinth toothing formation according to the invention. 16 indicates a toothing formation in which the individual teeth are in rod form, that is to say circular in cross section. 17 shows a toothing formation which is formed from teeth of square cross section arranged in the manner of a chessboard. An irregular labyrinth toothing formation is illustrated in section 18. It should preferably be ensured here that there is uniform mass distribution over the circumference of the rotor as a whole and no imbalance occurs. 19 illustrates, schematically, an irregular labyrinth toothing formation in which the individual teeth have a configuration, in cross section, which differs from the basic geometrical shapes. Of course, the sections 16-19 are not present in a single dispersing rotor according to the invention; rather, they are showing, schematically, four possible configurations of the labyrinth toothing formation of a rotor.

The invention claimed is:

1. A dispersing rotor for homogenizing free-flowing media, said dispersing rotor having at least two circumferentially running walls that are concentric and radially spaced apart by at least one circumferentially running channel, wherein each circumferentially running wall comprises openings defined by a multiplicity of axially extending teeth attached at two axial ends in a circumferentially running row such that said dispersing rotor has at least two radially spaced-apart rows of teeth;

wherein said openings in said at least two circumferentially running walls form a labyrinth toothing formation for medium passing radially outward from the direction of the rotor axis through said openings in said circumferentially running walls and moving circumferentially through at least one circumferentially running channel, wherein said labyrinth toothing formation is formed without interaction of said dispersing rotor with a stator or a second rotor.

2. The dispersing rotor according to claim 1, wherein said dispersing rotor has 2 to 16 radially spaced-apart rows (5) of teeth.

3. The dispersing rotor according to claim 1, wherein said dispersing rotor has 2 to 8 radially spaced-apart rows (5) of teeth.

4. The dispersing rotor according to claim 1, wherein said dispersing rotor has 4 to 8, radially spaced-apart rows (5) of teeth.

5. The dispersing rotor according to claim 1, wherein said dispersing rotor is closed at one or both axial ends.

6. The dispersing rotor according to claim 1, wherein said rotor-toothing formation has an axial height of 10 to 30 mm.

7. The dispersing rotor according to claim 1, wherein said rotor-toothing formation has an axial height of is 12 to 25 mm.

8. The dispersing rotor according to claim 1, wherein said rotor-toothing formation comprises teeth (6) having radially directed gaps of 0.3 to 3 mm.

9. The dispersing rotor according to claim 1, wherein said rotor-toothing formation comprises teeth (6) having radially directed gaps of 0.5 to 1.5 mm.

10. The dispersing rotor according to claim 1, wherein said rotor-toothing formation comprises teeth (6) or rows of teeth having circumferentially directed gaps of 0.5 to 4 mm.

11. The dispersing rotor according to claim 1, wherein said rotor-toothing formation comprises teeth (6) or rows of teeth having circumferentially directed gaps of 1 to 3 mm.

12. The dispersing rotor according to claim 1, wherein said rotor-toothing formation comprises teeth (6) or rows of teeth having circumferentially directed gaps of 1.5 to 2.5 mm.

13. The dispersing rotor according to claim 1, wherein said rotor comprises a row of teeth having coverage over a circumference of said row of teeth, wherein the coverage of said row of teeth over said circumference is 40 to 80%.

14. The dispersing rotor according to claim 13, wherein the coverage of said row of teeth over said circumference is 50 to 70%.

15. The dispersing rotor according to claim 1, wherein two radially adjacent rows of teeth provide, together, for full coverage.

16. The dispersing rotor according to claim 1, comprising teeth having circumferentially oriented delivery surfaces (16) that are designed to subject medium that comes into contact therewith to an impulse component in the radially outward direction.

17. An homogenization apparatus for homogenizing free-flowing media, wherein said homogenization apparatus has a dispersing rotor according to claim 1, wherein said homogenization apparatus does not have any stator-toothing formation engaging in said rotor-toothing formation and does not have a second rotor with a rotor-toothing formation engaging in said first rotor-toothing formation.

18. The homogenization apparatus according to claim 17, wherein said dispersing rotor is arranged in a lower region of a homogenization tank.

19. The homogenization apparatus according to claim 17, wherein said dispersing rotor is arranged in a base region of a homogenization tank.

20. The homogenization apparatus according to claim 17, wherein said dispersing rotor is arranged in a medium-channeling conduit.

21. The homogenization apparatus according to claim 17, wherein said dispersing rotor has a contactless drive.

22. The homogenization apparatus according to claim 21, wherein said contactless drive is a magnetic drive.

* * * * *